US008808108B2

(12) United States Patent
Schweigert

(10) Patent No.: US 8,808,108 B2
(45) **Date of Patent: *Aug. 19, 2014**

(54) GOLF CLUB HEAD AND METHOD OF MANUFACTURE

(75) Inventor: Bradley D. Schweigert, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 341 days.

This patent is subject to a terminal disclaimer.

(21) Appl. No.: 12/463,326

(22) Filed: May 8, 2009

(65) Prior Publication Data

US 2010/0285901 A1 Nov. 11, 2010

(51) Int. Cl.
*A63B 53/04* (2006.01)

(52) U.S. Cl.
USPC ..... 473/345; 473/346

(58) Field of Classification Search
USPC ..... 473/345, 346
See application file for complete search history.

(56) References Cited

U.S. PATENT DOCUMENTS

| | | | |
|---|---|---|---|
| D248,179 | S | 6/1978 | Riley |
| 4,139,196 | A | 2/1979 | Riley |
| D352,755 | S | 11/1994 | Cornish, III |
| D357,290 | S | 4/1995 | Viollaz et al. |
| 5,547,188 | A | 8/1996 | Dumontier et al. |
| D379,391 | S | 5/1997 | Moore |
| D398,682 | S | 9/1998 | Moore |
| D404,098 | S | 1/1999 | Ishikawa et al. |
| D418,888 | S | 1/2000 | Williams, Jr. |
| D425,589 | S | 5/2000 | Ishikawa et al. |
| D426,604 | S | 6/2000 | Besnard et al. |
| D441,818 | S | 5/2001 | Sato |
| D442,245 | S | 5/2001 | Roach et al. |
| D445,470 | S | 7/2001 | Teramoto |
| D446,268 | S | 8/2001 | Satoh et al. |
| D446,563 | S | 8/2001 | Besnard et al. |
| D461,865 | S | 8/2002 | Nagai et al. |
| D463,838 | S | 10/2002 | Besnard et al. |
| 6,475,102 | B2 | 11/2002 | Helmstetter et al. |
| D472,950 | S | 4/2003 | Burnett et al. |
| 6,679,784 | B2 * | 1/2004 | Mase ..... 473/290 |
| D490,489 | S | 5/2004 | Madore |
| D492,745 | S | 7/2004 | Tang |

(Continued)

FOREIGN PATENT DOCUMENTS

| | | |
|---|---|---|
| WO | 2005035074 | 4/2005 |
| WO | 2007076304 | 7/2007 |

OTHER PUBLICATIONS

Marty R. Jertson, et al., "Golf Club Head," U.S. Appl. No. 29/303,338, filed Feb. 7, 2008.

(Continued)

*Primary Examiner* — Michael Dennis

(57) ABSTRACT

Embodiments of golf clubs and methods of manufacture are described herein. In one embodiment, an apparatus includes a golf club head body, which includes a heel, a toe opposite the heel, a strike face including a leading edge, a rear opposite the strike face, and a hosel including a hosel axis extending through a center of the hosel and located at the heel. In this embodiment, the leading edge of the strike face is located approximately at the hosel axis or between the rear of the golf club head body and the hosel axis. Other embodiments and related methods are also disclosed herein.

27 Claims, 2 Drawing Sheets

(56) References Cited

U.S. PATENT DOCUMENTS

| | | | |
|---|---|---|---|
| D508,544 | S | 8/2005 | Madore |
| D509,272 | S | 9/2005 | Smith et al. |
| D513,424 | S | 1/2006 | Erickson et al. |
| D514,179 | S | 1/2006 | Chen et al. |
| D518,129 | S | 3/2006 | Poynor et al. |
| D518,543 | S | 4/2006 | Aguinaldo et al. |
| D521,093 | S | 5/2006 | Jorgensen et al. |
| D522,077 | S | 5/2006 | Schweigert et al. |
| D522,601 | S | 6/2006 | Schweigert et al. |
| D523,103 | S | 6/2006 | Hocknell et al. |
| D523,498 | S | 6/2006 | Chen et al. |
| D523,502 | S | 6/2006 | Jorgensen |
| D526,694 | S | 8/2006 | Schweigert et al. |
| D530,761 | S | 10/2006 | Evans et al. |
| D532,473 | S | 11/2006 | Chen et al. |
| D532,854 | S | 11/2006 | Oldknow |
| D535,343 | S | 1/2007 | Chen et al. |
| D536,049 | S | 1/2007 | Evans et al. |
| D537,139 | S | 2/2007 | Breier et al. |
| D537,495 | S | 2/2007 | Schweigert et al. |
| D537,496 | S | 2/2007 | Serrano et al. |
| D537,895 | S | 3/2007 | Breier et al. |
| D538,363 | S | 3/2007 | Schweigert et al. |
| D538,367 | S | 3/2007 | Foster et al. |
| D538,371 | S | 3/2007 | Kawami |
| D538,866 | S | 3/2007 | Kim et al. |
| D538,867 | S | 3/2007 | Cleveland et al. |
| D539,371 | S | 3/2007 | Chen et al. |
| D550,318 | S | 9/2007 | Oldknow |
| D550,799 | S | 9/2007 | Lin |
| D552,198 | S | 10/2007 | Schweigert et al. |
| D553,206 | S | 10/2007 | Morales et al. |
| D555,745 | S | 11/2007 | Rollinson et al. |
| D557,362 | S | 12/2007 | Serrano et al. |
| D557,363 | S | 12/2007 | Jertson et al. |
| D558,287 | S | 12/2007 | Jertson et al. |
| D558,288 | S | 12/2007 | Jertson et al. |
| D561,286 | S | 2/2008 | Morales et al. |
| D562,421 | S | 2/2008 | Jertson et al. |
| D563,498 | S | 3/2008 | Jertson et al. |
| D564,054 | S | 3/2008 | Jertson et al. |
| D564,055 | S | 3/2008 | Jertson et al. |
| D564,056 | S | 3/2008 | Chen et al. |
| D566,214 | S | 4/2008 | Evans et al. |
| D567,317 | S | 4/2008 | Jertson et al. |
| D567,891 | S | 4/2008 | Serrano et al. |
| D569,933 | S | 5/2008 | Jertson et al. |
| D569,934 | S | 5/2008 | Jertson et al. |
| D569,935 | S | 5/2008 | Schweigert et al. |
| D569,936 | S | 5/2008 | Schweigert et al. |
| D570,937 | S | 6/2008 | Schweigert et al. |
| D570,938 | S | 6/2008 | Jertson et al. |
| D570,939 | S | 6/2008 | Chen et al. |
| D570,940 | S | 6/2008 | Chen et al. |
| D570,941 | S | 6/2008 | Chen et al. |
| D571,882 | S | 6/2008 | Soracco |
| D572,324 | S | 7/2008 | Chen et al. |
| D572,785 | S | 7/2008 | Chen et al. |
| D572,787 | S | 7/2008 | Sanchez et al. |
| D572,791 | S | 7/2008 | Jertson et al. |
| D573,216 | S | 7/2008 | Sanchez et al. |
| D573,217 | S | 7/2008 | Sanchez et al. |
| D573,218 | S | 7/2008 | Sanchez et al. |
| D573,676 | S | 7/2008 | Chen et al. |
| D574,046 | S | 7/2008 | Chen et al. |
| D574,048 | S | 7/2008 | Kadoya |
| D578,587 | S | 10/2008 | Hoffman et al. |
| D579,066 | S | 10/2008 | Dipert et al. |
| D579,067 | S | 10/2008 | Hoffman et al. |
| D580,504 | S | 11/2008 | Bosilkovski et al. |
| D583,432 | S | 12/2008 | Serrano et al. |
| 7,632,196 | B2 * | 12/2009 | Reed et al. ..... 473/345 |
| 2005/0043117 | A1 | 2/2005 | Gilbert et al. |
| 2006/0293120 | A1 | 12/2006 | Cackett et al. |
| 2007/0293348 | A1 | 12/2007 | Hocknell et al. |
| 2008/0020857 | A1 | 1/2008 | Stevens |
| 2008/0039228 | A1 | 2/2008 | Breier et al. |
| 2008/0153625 | A1 | 6/2008 | Morales et al. |
| 2008/0171612 | A1 | 7/2008 | Serrano et al. |
| 2009/0017937 | A1 | 1/2009 | Oyama |
| 2009/0069114 | A1 | 3/2009 | Tang |
| 2009/0088272 | A1 | 4/2009 | Foster et al. |

OTHER PUBLICATIONS

Marty R. Jertson, et al., "Golf Club Head," U.S. Appl. No. 29/303,340, filed Feb. 7, 2008.

Bradley D. Schweigert et al., "Golf Club Head," U.S. Appl. No. 29/331,704, filed Jan. 30, 2009.

Bradley D. Schweigert et al., "Golf Club Head," U.S. Appl. No. 29/331,706, filed Jan. 30, 2009.

Marty R. Jertson, et al., "Golf Club Head," U.S. Appl. No. 29/331,707, filed Jan. 30, 2009.

Marty R. Jerston, et al., "Golf Club Head," U.S. Appl. No. 29/331,711, filed Jan. 30, 2009.

Bradley D. Schweigert, et al., "Golf Clubs and Methods of Manufacture," U.S. Appl. No. 11/828,158, filed Jul. 25, 2007.

* cited by examiner

700

GOLF CLUB HEAD AND METHOD OF MANUFACTURE

TECHNICAL FIELD

This disclosure relates generally to golf equipment, and relates more particularly to golf clubs and methods of manufacture.

BACKGROUND

Many people who play golf miss hit the golf ball when hitting the golf ball off of a tee and also when hitting the golf ball off of the ground. During these miss hits, the golf ball trajectory is often too short and too high.

Figure 1:
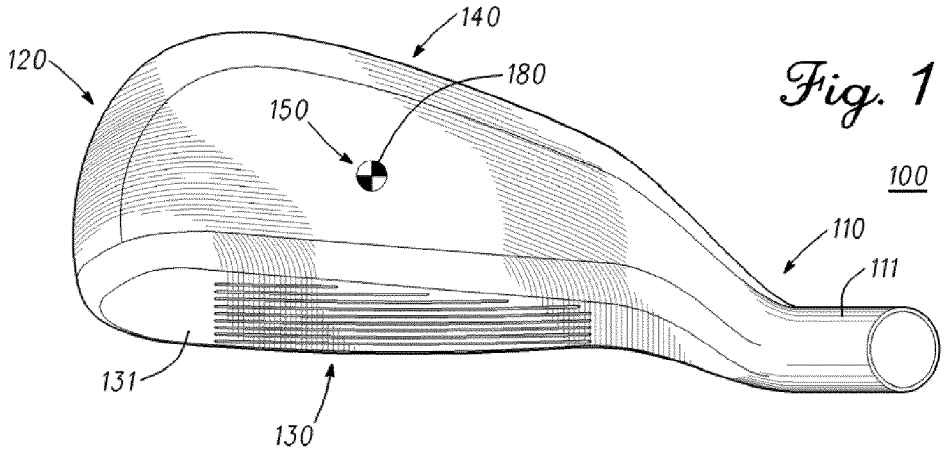
FIG. 1 depicts a top view of a golf club head, according to an embodiment.
Figure 2:
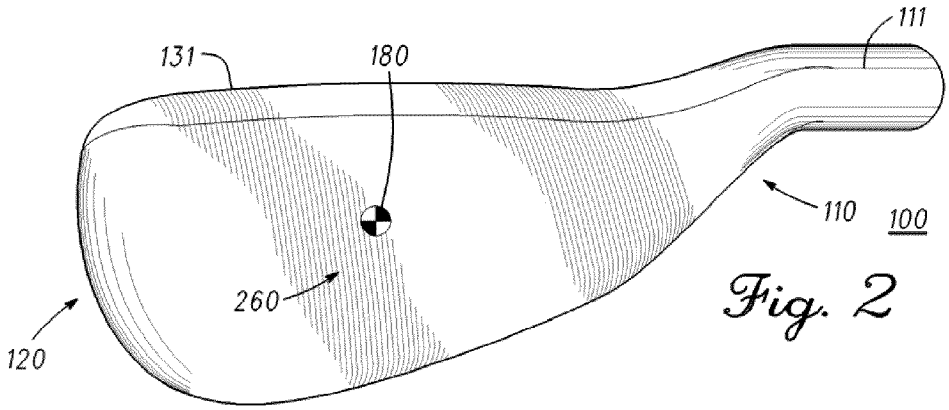
FIG. 2 depicts a bottom view of the golf club head of FIG. 1.
Figure 3:
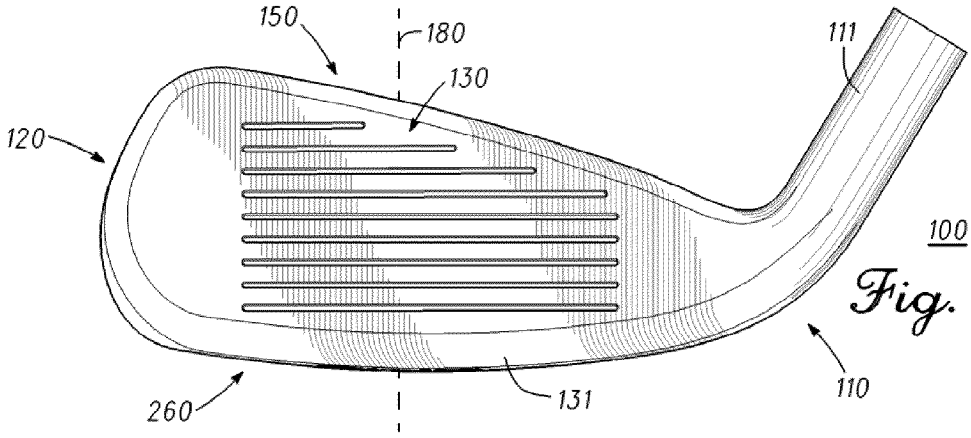
FIG. 3 depicts a front view of the golf club head of FIG. 1.
Figure 4:
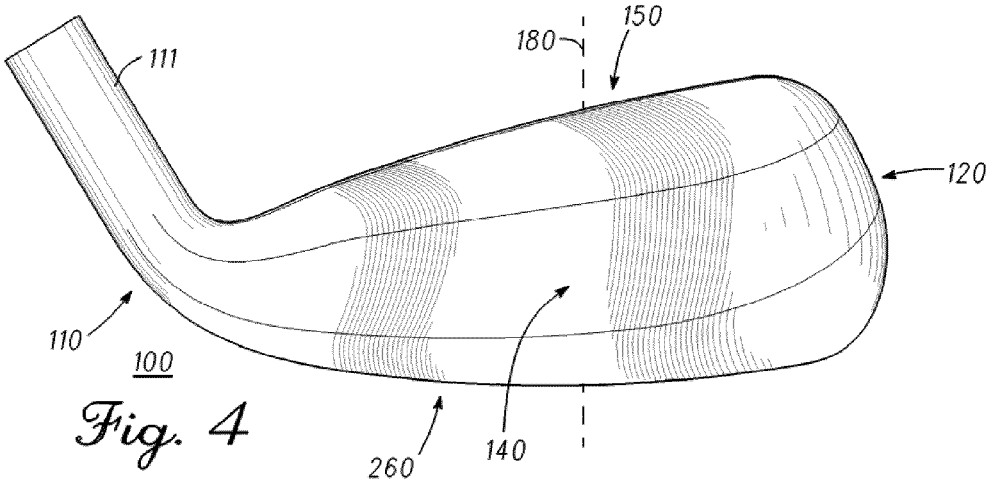
FIG. 4 depicts a rear view of the golf club head of FIG. 1.
Figure 5:
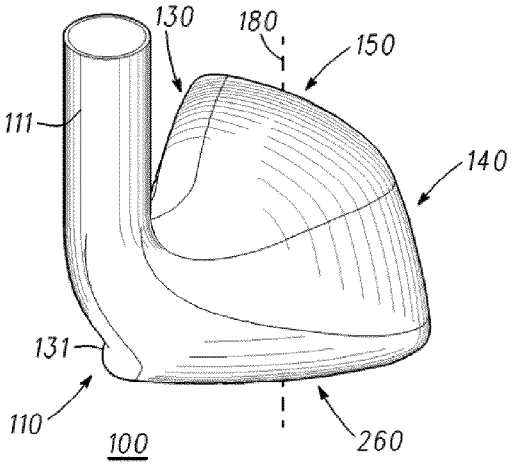
FIG. 5 depicts a heel view of the golf club head of FIG. 1.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the golf club attachment mechanism and related methods described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the golf club attachment mechanism and related methods described herein are, for example, capable of operation in other orientations than those illustrated or otherwise described herein.

The terms "couple," "coupled," "couples," "coupling," and the like should be broadly understood and refer to connecting two or more elements, electronically, mechanically, or otherwise. Coupling may be for any length of time, e.g., permanent or semi permanent or only for an instant. The absence of the word "removably," "removable," and the like near the word "coupled" and the like does not mean that the coupling, etc. in question is or is not removable.

DESCRIPTION

In one embodiment, an apparatus includes a golf club head body, which includes a heel, a toe opposite the heel, a strike face including a leading edge, a rear opposite the strike face, and a hosel including a hosel axis extending through a center of the hosel and located at the heel. In this embodiment, the leading edge of the strike face is located approximately at the hosel axis or between the rear of the golf club head body and the hosel axis. Also, the golf club head body can be characterized by at least one of a first ratio of a moment of inertia of the golf club head body versus a mass of the golf club head body greater than approximately 12 centimeters squared, a second ratio of the moment of inertia versus a volume of the golf club head body greater than approximately 25 grams per centimeter, or a third ratio of a first distance versus a second distance greater than approximately 0.7. The first distance can be measured between a first plane intersecting the hosel axis and a center of gravity of the golf club head body. The second distance can be measured between a second plane intersecting the leading edge of the strike face and the center of gravity. The first and second planes can be perpendicular to a third plane representing a ground surface when the golf club head body is at an address position. Other examples, embodiments, and related methods are further described below.

Turning now to the figures, FIG. 1 depicts a front view of golf club head body 100, according to a first embodiment. Golf club head body 100 can be a portion of a golf club, where the golf club includes a golf club shaft coupled to golf club head body 100. The golf club can be an iron-type golf club, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc. In a different embodiment, the golf club can be a wood-type golf club, a hybrid-type golf club, or a putter-type golf club. As an example, when the golf club is a hybrid golf club, golf club head 100 is a hybrid golf club head. Also, when the golf club is a wood or a hybrid, golf club head 100 can be hollow. In the same or a different embodiment, golf club head 100 can include a permanent or adjustable weight.

As shown in FIGS. 1-6, golf club head body 100 includes heel 110, toe 120, strike face 130, rear 140, crown 150, and sole 260. Crown 150 can also be referred to as a top rail in some embodiments. Toe 120 is opposite heel 110, and as explained in more detail below, toe 120 can be wider than heel 110. Rear 140 is located between heel 110 and toe 120, and is opposite strike face 130. Although not illustrated in the drawings, golf club head body 100 can also include a notch at heel 110.

Strike face 130 is located between heel 110 and toe 120 and includes a leading edge 131. Strike face 130 can also have a loft angle. Strike face 130 can be referred to as a front face. Strike face 130 can be an integral part of golf club head body 100, or strike face 130 can be a separate piece from, or an insert for, golf club head body 100. Strike face 130 includes one or more grooves, which can extend across strike face 130 from heel 110 to toe 120. The grooves can also be stacked vertically above one another from sole 260 to crown 150.

Golf club head body 100 also includes hosel 111, which is located at heel 110. Hosel 111 includes hosel axis 612 (FIG. 6), which can extend through a center of hosel 111 and along a length of hosel 111. Hosel axis 612 is explained in more detail below. A golf club shaft can be coupled to hosel 111. In a different embodiment, golf club head body 100 has a hole, and not a hosel, to which a golf club shaft is coupled. In this different embodiment, the hole is still referred to as a hosel. The hole can also have a hosel axis.

As depicted in FIGS. 1-6, toe 120 is wider than heel 110. In the same or different embodiment, the widest portion of golf club head body 100 can be at toe 120, can closer to toe 120 than heel 110, and/or can be located between a center of golf club head body 100 and toe 120. By way of example, and not by way of limitation, a distance between heel 110 and toe 120 can be approximately 12 or 13 centimeters (cm), and a widest portion of golf club head body 100 can be approximately 2 or 3 cm towards a center of golf club head body 100 from toe 120, where the "width" can be measured from strike face 130 to rear 140 in a direction substantially perpendicular to strike face 130.

With toe 120 being generally wider than heel 110, the moment of inertia (MOI) of golf club head body 100 can be increased. For example, a wider toe 120 can help position center of gravity ("CG") 680 (FIG. 6) of golf club head body 100 in a location where the mass distribution of golf club head body 100 works more efficiently for increasing the MOI of golf club head body 100. MOI can be measured about vertical axis 180, which extends through CG 680 of golf club head body 100. CG 680 can be positioned to produce a higher launch angle and/or a lower spin back spin for the golf ball than for a typical golf club head, which is explained in more detail below. This golf club head design can provide a higher golf club head MOI without significantly increasing golf club head volume. The higher MOI can provide less golf club head twisting during off-center hits or miss hits, which can result in longer and straighter miss hits. The reduction in twisting can conserve energy and can help to maintain a more consistent ball speed during miss hits. Less club head twisting can also help to keep the ball flight straighter at the beginning of the trajectory and can also reduce the side spin on the golf ball caused by the gear effect, which is also explained in more detail below.

Golf club head body 100 can include a weight. When golf club head body 100 is hollow, as described above, the weight can be located inside of golf club head body 100. The weight can be used to adjust the mass distribution of golf club head body 100, to adjust the location of CG 680, and also to increase the MOI of golf club head body 100. The mass distribution of golf club head body 100, CG 680, and the MOI of golf club head body 100 can also be adjusted without using a weight, but instead, as an example, by distributing the intrinsic material and/or the thickness of such material used to create golf club head body 100.

The efficiency of the mass distribution can be measured in golf club head body 100 by taking a ratio of the MOI of golf club head body 100 versus the mass of golf club head body 100. In some embodiments, this ratio can be used to characterize irons and/or hollow body metal woods and/or hybrids. For example, this ratio can be greater than approximately 12 centimeters squared (cm2). In another embodiment, the ratio can be greater than or equal to approximately 13 cm2, and in a further embodiment, the ratio can be approximately 13 cm2 to approximately 15 cm2. In the prior art, this ratio is much lower. By way of example, and not by way of limitation, the MOI of golf club head body 100 can be approximately 2,700 cm2-grams (cm2-g) to approximately 3,700 cm2-g, and the mass of golf club head body 100 can be approximately 160 grams (g) to approximately 300 g. As another example, without limiting the apparatuses or methods described herein, the MOI of golf club head body 100 can be approximately 3,265 cm2-g, and the mass of golf club head body 100 can be approximately 233 g.

This ratio can normalize the MOI based on the golf club head mass. For irons, the golf club head mass varies with the length of the golf club shaft to keep the swing weight constant. As the golf club head mass increases, however, the golf club head MOI also increases so this ratio can provide a normalized value that is a more useful comparison from golf club head to golf club head.

Another ratio that can be used to measure the efficiency of the mass distribution of golf club head body 100 is a ratio of the MOI of golf club head body 100 to the volume of golf club head body 100. In some embodiments, the volume can be defined as the volume of golf club head body 100 as measured by the external surfaces of golf club head body 100. In the same or different embodiment, this ratio can be used to characterize hollow body metal woods and/or hybrids. For example, the ratio can be greater than approximately 25 grams per centimeter (g/cm). In a different embodiment, this ratio can be greater than approximately 27 g/cm, and in a further embodiment, this ratio can be approximately 29 g/cm to approximately 33 g/cm. In the prior art, this ratio is much lower. By way of example, and not by way of limitation, the MOI of golf club head body 100 can be approximately 2,700 cm2-g to approximately 3,700 cm2-g, and the volume of golf club head body 100 can be approximately 50 centimeters cubed (cm3) to approximately 150 cm3. As another example, without limiting the apparatuses or methods described herein, the MOI of golf club head body 100 can be approximately 3,265 cm2-g, and the volume of golf club head body 100 can be approximately 105 cm3.

Figure 6:
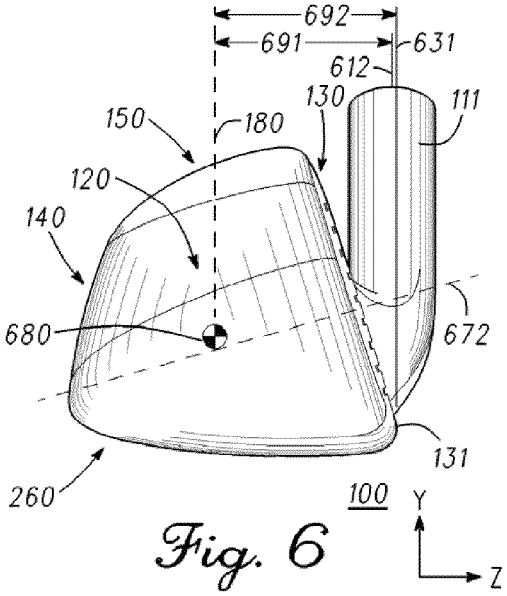
FIG. 6 depicts a toe view of the golf club head of FIG. 1.

In some embodiments, hosel 111 is located at a more forward position, as illustrated in FIG. 6. In one embodiment, hosel 111 is forwardly offset. For example, hosel 111 and/or hosel axis 612 can be located approximately at leading edge 131 or in front of leading edge 131. Similarly, leading edge 131 can be located approximately at hosel 111 or hosel axis 612, or leading edge 131 can be located between: (a) rear 140; and (b) hosel 111 and/or hosel axis 612. In these examples, the CG of golf club head body 100 can be located behind hosel 111 and/or hosel axis 612, and by doing so, the launch angle of the golf ball can be increased. Also in this example, CG 680 can be positioned to be closer to leading edge 131 of strike face 130. By doing so, impact force line 672 can be located closer to CG 680, and any addition to the spin of the golf ball caused by the gear effect can be reduced. Impact force line 672 can be the force line through a center of a golf ball struck by strike face 130. Impact force line 672 can be perpendicular to strike face 130.

To characterize this forward position of hosel 111, golf club head body 100 can have a ratio of a first distance 691 (measured between hosel axis 612 and CG 680) versus a second distance 692 (measured between CG 680 and plane 631 intersecting leading edge 131 of strike face 130, where plane 631 is perpendicular to a ground surface when golf club head body 100 is at an address position), as shown in FIG. 6. In some embodiments, this ratio is greater than approximately 0.7. In a different embodiment, the ratio is greater than or equal to approximately 0.8, and in a further embodiment, the ratio is approximately 0.8 to approximately 1. In the prior art, the ratio is much lower.

As an example, for a 17 degree hybrid golf club head body, which can be the lowest lofted hybrid golf club head in a set of golf clubs, distance 691 equals approximately 1.88 centimeters (cm); distance 692 equals approximately 1.95 cm; and the ratio of distance 691/distance 692 equals approximately 0.96. As another example, for a 31 degree hybrid golf club head body, which can be the highest lofted hybrid golf club head in a set of golf clubs, distance 691 equals approximately 2.01 cm; distance 692 equals approximately 2.31 cm; and distance 691/distance 692 equals approximately 0.87. In one embodiment, distance 691 is not too large to minimize hitting draws or hooks, and distance 691 is not too small to minimize hitting fades.

Maximizing distance 691 while minimizing distance 692 can help to create a higher launch angle and a lower spin on the golf ball. In particular, as explained in more detail below, maximizing distance 691 can help to increase the initial launch angle of the golf ball, and minimizing distance 692 can help to decrease the initial spin rate of the golf ball, assuming that the CG height remains unchanged. In general, golf ball spin can increase when the distance from the CG to the impact force line can be increased, and the increased distance places a larger moment force on the golf club head. The impact force causes the golf club head to twist around the CG, and places an opposite twisting force on the golf ball (i.e., the gear effect). The impact force line can vary based on the use of the golf club. For example, if the impact force line is below the CG (which often occurs when the golf ball is lying on the ground), the twisting increases the back spin rate of the golf ball. The increased back spin rate can be undesirable for increasing the distance of the golf ball trajectory.

More specifically, the CG effect on the club head delivery or the initial launch angle of the golf ball can be explained as follows. The position of the CG relative to the hosel axis can be a large factor for the "pre-impact" effect (i.e., the effect of the golf club head before it impacts the golf ball). During the downward swing of the golf club head, the CG of the golf club head desires to align itself with the axis of the golf club shaft through the hands of the person holding the golf club. This desired alignment causes the golf club shaft to bend and deliver the golf club head with more dynamic loft when it strikes the golf ball. One benefit of the dynamic loft is that the launch angle is increased without increasing the spin on the golf ball and also without decreasing the velocity of the golf ball as much as if the increased launch angle was achieved through the use of adding static loft by, for example, increasing the loft angle of the golf club head. This phenomenon occurs because the bending of the golf club shaft moves the attack angle (or force line) of the golf club head in a more upward direction. Adding static loft can increase the launch angle of the golf ball, but it also increases the angular difference between the initial launch angle of the golf ball and the attack angle of the golf club head, which increases the spin of the golf ball and decreases the golf ball velocity.

The CG effect on the gear effect (i.e., the spin on the golf ball) can be explained as follows. When the golf club head impacts the golf ball, the golf ball places a force on the golf club head that can be represented as a force vector extending out normal to the loft plane. When this force vector is not in-line with the CG of the golf club head, the impact force from the golf ball can cause the golf club head to twist about the CG, and an equal and opposite twisting force is placed on the golf ball. A force vector located above the CG of the golf club head results in a higher launch angle combined with a reduced spin rate. The twisting force is a moment that can be calculated by taking the impact force multiplied by the perpendicular distance from the CG of the golf club head to the force vector. Changes in the location of the CG of the golf club head in the vertical direction (Y-axis in FIG. 6) and/or in the horizontal direction (Z-axis in FIG. 6) will affect the moment arm distance.

The force vector can be located below CG 680 of golf club head body 100, which can be common with fairway woods, hybrids, and irons when the golf ball is on the ground. In this configuration, golf club head body 100 rotates forward, which decreases the effective loft angle and creates a backspin on the golf ball. In a second configuration, the force vector can be located above CG 680 of golf club head body 100, which can be common with drivers when the golf ball is on a golf tee. Here, the golf club head rotates backward, which increases the effective loft angle and creates a top spin effect on the golf ball. To increase the likelihood of the second configuration, the CG can be designed to be approximately in-line with the force line, as shown in FIG. 6 regardless of whether the golf ball is lying on the ground or on a golf tee. The force line can be designed to extend perpendicularly through a center of the hitting portion of strike face 130. If the CG is not designed to be approximately in-line with the force line, then in one embodiment, the CG is located below the force line to increase the likelihood of the more desirable configuration.

Figure 7:
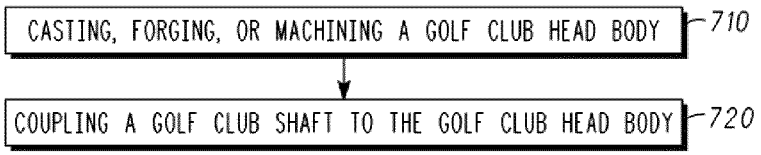
FIG. 7 depicts a flow chart for a method according to another embodiment.

FIG. 7 depicts a flow chart 700 for a method according to another embodiment. Flow chart 700 includes casting, forging, machining, or otherwise forming a golf club head body (block 710). As an example, the golf club head body of block 710 can be similar to golf club head body 100 of FIGS. 1-6.

In particular, the golf club head body of block 710 can include a heel, a toe opposite the heel and wider than the heel, a strike face, a rear opposite the strike face, and a hosel comprising a hosel axis and located at the heel. As explained above with reference to FIGS. 1-6, the hosel for the golf club head body of block 710 can be similar to a traditional hosel, or the hosel of block 710 can be similar a hole within golf club head body. As also explained above with reference to FIGS. 1-6, the strike face can be integral with or separate from the golf club head body. In an embodiment where the strike face is separate from the golf club head body, block 710 can include coupling the strike face to another portion of the golf club head body.

Regardless of whether the strike face is integral with the golf club head body, the strike face can include a leading edge. The leading edge of the strike face can be located approximately at the hosel axis or between the rear of the golf club head body and the hosel axis. The golf club head body can also be characterized by at least one of: (a) a first ratio of a moment of inertia of the golf club head body versus a mass of the golf club head body greater than approximately 12 cm2; (b) a second ratio of the moment of inertia versus a volume of the golf club head body greater than approximately 25 g/cm; or (c) a third ratio of a first distance versus a second distance greater than approximately 0.7. The first distance can be measured between: (a) a vertical plane that extends through the hosel axis and is perpendicular to a horizontal plane that represent a ground surface when the golf club head body is at an address position; and (b) a center of gravity of the golf club head body. The second distance can be measured between: (a) a vertical plane intersecting the leading edge of the strike face and is perpendicular to the horizontal plane that represents the ground surface when the golf club head body is at the address position; and (b) the center of gravity of the golf club head body.

After block 710, flow chart 700 can include coupling a golf club shaft to the golf club head body (block 720). As an example, the golf club shaft can be coupled to the hosel of the golf club head body. The resulting golf club created after coupling together the golf club shaft and the hosel can be similar to the golf club describe above with reference to FIGS. 1-6.

Although golf club heads and methods of manufacture have been described with reference to specific embodiments, various changes may be made without departing from the scope of the golf club head with grooves and related methods. Various examples of such changes have been given in the foregoing description. Accordingly, the disclosure of embodiments is intended to be illustrative of the scope of the application and is not intended to be limiting. It is intended that the scope of this application shall be limited only to the extent required by the appended claims. Therefore, the detailed description of the drawings, and the drawings themselves, disclose at least one preferred embodiment of a golf club head and methods of manufacture thereof, and may disclose alternative embodiments of the same.

All elements claimed in any particular claim are essential to the golf club head with grooves and methods of manufacture thereof claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An apparatus comprising:

a golf club head body comprising:

a heel;

a toe opposite the heel;

a strike face comprising a leading edge;

a rear opposite the strike face; and a hosel comprising a hosel axis and located at the heel and approximately at or in front of the leading edge;

wherein:

a toe-heel distance is equal to a distance between a first point at the toe and a second point at the heel;

a front-rear distance is equal to a distance between a third point at the strike face and a fourth point at the rear;

the golf club head body comprises:

a first ratio of a moment of inertia of the golf club head body versus a mass of the golf club head body greater than approximately 12 $cm^2$ when a density of the golf club head body is equal to a first density, the toe-heel distance is equal to a first toe-heel distance, and the front-rear distance is equal to a first front-rear distance;

a second ratio of the moment of inertia versus a volume of the golf club head body greater than approximately 25 g/cm when the density of the golf club head body is equal to the first density, the toe-heel distance is equal to the first toe-heel distance, and the front-rear distance is equal to the first front-rear distance; and a third ratio of a first distance versus a second distance greater than approximately 0.7;

the first distance is measured as a shortest distance between a first plane intersecting the hosel axis and a center of gravity of the golf club head body;

the second distance is measured as a shortest distance between a second plane intersecting the leading edge of the strike face and the center of gravity;

the first and second planes are perpendicular to a third plane representing a ground surface when the golf club head body is at an address position and when the density of the golf club head body is equal to the first density, the toe-heel distance is equal to the first toe-heel distance, and the front-rear distance is equal to the first front-rear distance; and the volume of the golf club head body is between 60 $cm^3$ and 150 $cm^3$.

2. The apparatus of claim 1, wherein the first ratio is greater than or equal to approximately 13 $cm^2$ when the density of the golf club head body is equal to the first density, the toe-heel distance is equal to the first toe-heel distance, and the front-rear distance is equal to the first front-rear distance.

3. The apparatus of claim 1, wherein the first ratio is approximately 13 $cm^2$ to approximately 15 $cm^2$ when the density of the golf club head body is equal to the first density, the toe-heel distance is equal to the first toe-heel distance, and the front-rear distance is equal to the first front-rear distance.

4. The apparatus of claim 1, wherein the second ratio is greater than or equal to approximately 27 g/cm when the density of the golf club head body is equal to the first density, the toe-heel distance is equal to the first toe-heel distance, and the front-rear distance is equal to the first front-rear distance.

5. The apparatus of claim 1, wherein the second ratio is approximately 29 g/cm to approximately 33 g/cm when the density of the golf club head body is equal to the first density, the toe-heel distance is equal to the first toe-heel distance, and the front-rear distance is equal to the first front-rear distance.

6. The apparatus of claim 1, wherein the third ratio is greater than or equal to approximately 0.8 when the density of the golf club head body is equal to the first density, the toe-heel distance is equal to the first toe-heel distance, and the front-rear distance is equal to the first front-rear distance.

7. The apparatus of claim 1, wherein the third ratio is approximately 0.8 to approximately 1.0 when the density of the golf club head body is equal to the first density, the toe-heel distance is equal to the first toe-heel distance, and the front-rear distance is equal to the first front-rear distance.

8. The apparatus of claim 1, wherein the golf club head body comprises a hybrid golf club head body.

9. The apparatus of claim 1, wherein the golf club head body is hollow.

10. The apparatus of claim 1, further comprising a weight inside the golf club head body.

11. The apparatus of claim 1, further comprising a shaft coupled to the hosel.

12. An apparatus comprising:

a hollow golf club head body comprising:

a heel;

a toe opposite the heel;

a strike face comprising a leading edge, having a loft angle, and located between the heel and the toe;

a rear between the heel and the toe and opposite the strike face;

a hosel comprising a hosel axis and located at the heel; and a moment of inertia, a mass, a volume, and a center of gravity;

wherein:

a toe-heel distance is equal to a distance between a first point at the toe and a second point at the heel;

a front-rear distance is equal to a distance between a third point at the strike face and a fourth point at the rear;

the leading edge of the strike face is located approximately at the hosel axis or between the rear of the hollow golf club head body and the hosel axis;

the hollow golf club head body is characterized by:

a second ratio of the moment of inertia versus the volume greater than or equal to approximately 27 g/cm when a density of the hollow golf club head body is equal to a first density, the toe-heel distance is equal to a first toe-heel distance, and the front-rear distance is equal to a first front-rear distance; and a third ratio of a first distance versus a second distance is greater than or equal to approximately 0.8;

the first distance is measured as a shortest distance between the center of gravity and a first vertical plane that extends through the hosel axis and that is normal to a horizontal plane representing a ground surface when the hollow golf club head body is at an address position;

the second distance is measured as a shortest distance between the center of gravity and a second vertical plane that extends through the leading edge of the strike face and that is normal to the horizontal plane representing the ground surface when the hollow golf club head body is at the address position and when the density of the hollow golf club head body is equal to the first density, the toe-heel distance is equal to the first toe-heel distance, and the front-rear distance is equal to the first front-rear distance; and the volume of the hollow golf club head body is between 60 $cm^3$ and 150 $cm^3$.

13. The apparatus of claim 12, wherein a first ratio of the moment of inertia versus the mass is greater than or equal to approximately 13 $cm^2$ when the density of the hollow golf club head body is equal to the first density, the toe-heel distance is equal to the first toe-heel distance, and the front-rear distance is equal to the first front-rear distance.

14. The apparatus of claim 13, wherein the first ratio is approximately 13 $cm^2$ to approximately 15 $cm^2$ when the density of the hollow golf club head body is equal to the first density, the toe-heel distance is equal to the first toe-heel distance, and the front-rear distance is equal to the first front-rear distance.

15. The apparatus of claim 12, wherein the second ratio is approximately 29 g/cm to approximately 33 g/cm when the density of the hollow golf club head body is equal to the first density, the toe-heel distance is equal to the first toe-heel distance, and the front-rear distance is equal to the first front-rear distance.

16. The apparatus of claim 12, wherein the third ratio is approximately 0.8 to approximately 1.0 when the density of the hollow golf club head body is equal to the first density, the toe-heel distance is equal to the first toe-heel distance, and the front-rear distance is equal to the first front-rear distance.

17. The apparatus of claim 12, wherein the hollow golf club head body comprises a hollow, hybrid golf club head body.

18. The apparatus of claim 12, further comprising a weight inside the hollow golf club head body.

19. The apparatus of claim 12, further comprising a golf club shaft coupled to the hosel.

20. The apparatus of claim 12, wherein a widest portion of the hollow golf club head body is at least one of:

located at the toe;

located closer to the toe than the heel; or located between the toe and a midpoint between the toe and the heel.

21. A method comprising:

forming a hybrid golf club head body comprising:

a heel;

a toe opposite the heel;

a strike face comprising a leading edge;

a rear opposite the strike face; and a hosel comprising a hosel axis and located at the heel;

wherein:

a toe-heel distance is equal to a distance between a first point at the toe and a second point at the heel;

a front-rear distance is equal to a distance between a third point at the strike face and a fourth point at the rear;

the leading edge of the strike face is located approximately at the hosel axis or between the rear of the hybrid golf club head body and the hosel axis;

the hybrid golf club head body is characterized by:

a first ratio of a moment of inertia of the hybrid golf club head body versus a mass of the hybrid golf club head body greater than approximately 12 $cm^2$ when a density of the hybrid golf club head body is equal to a first density, the toe-heel distance is equal to a first toe-heel distance, and the front-rear distance is equal to a first front-rear distance;

a second ratio of the moment of inertia versus a volume of the hybrid golf club head body greater than approximately 25 g/cm when the density of the hybrid golf club head body is equal to the first density, the toe-heel distance is equal to the first toe-heel distance, and the front-rear distance is equal to the first front-rear distance; and a third ratio of a first distance versus a second distance greater than approximately 0.7;

the first distance is measured as a shortest distance between a first plane intersecting the hosel axis and a center of gravity of the hybrid golf club head body;

the second distance is measured as a shortest distance between a second plane intersecting the leading edge of the strike face and the center of gravity;

the first and second planes are perpendicular to a third plane representing a ground surface when the hybrid golf club head body is at an address position and when the density of the hybrid golf club head body is equal to the first density, the toe-heel distance is equal to the first toe-heel distance, and the front-rear distance is equal to the first front-rear distance;

the first distance of the hybrid golf club head body is at least approximately 1.88 cm;

the second distance of the hybrid golf club head body is at least approximately 1.96 cm; and the volume of the hybrid golf club head body is between 60 $cm^3$ and 150 $cm^3$.

22. The method of claim 21, further comprising:

coupling a golf club shaft to the hosel.

23. The method of claim 21, wherein:

forming the hybrid golf club head body further comprises:

coupling the strike face to another portion of the hybrid golf club head body.

24. The apparatus of claim 1, wherein the golf club head body is a hollow, hybrid golf club head body.

25. The apparatus of claim 1, wherein:

the first distance of the golf club head body is at least approximately 1.88 cm; and the second distance of the golf club head body is at least approximately 1.96 cm.

26. The apparatus of claim 12, wherein:

the first distance of the hollow golf club head body is at least approximately 1.88 cm; and the second distance of the hollow golf club head body is at least approximately 1.96 cm.

27. The method of claim 21, wherein:

forming the hybrid golf club head body comprises:

forming a hollow, hybrid golf club head body.

* * * * *